United States Patent [19]

Schimbke et al.

[11] 4,343,987

[45] Aug. 10, 1982

[54] ELECTRIC BOILER

[75] Inventors: Paul A. Schimbke, Milwaukee, Wis.; Stanley A. Williams, Poole, England

[73] Assignee: Aqua-Chem, Inc., Milwaukee, Wis.

[21] Appl. No.: 38,891

[22] Filed: May 14, 1979

[51] Int. Cl.[3] ..... H05B 1/02

[52] U.S. Cl. ..... 219/287; 219/496; 219/497; 219/284; 219/296; 219/506; 219/486; 122/382

[58] Field of Search ..... 219/295, 284, 296, 273, 219/285-287, 496, 494, 497, 506, 485, 486, 498; 122/382, 379

[56] References Cited

U.S. PATENT DOCUMENTS

| | | | |
|---|---|---|---|
| 3,187,160 | 6/1965 | Williams | 219/295 |
| 3,488,474 | 1/1970 | Saunders | 219/287 |
| 3,760,775 | 9/1973 | Williams | 122/382 |
| 3,824,372 | 7/1974 | Eaton | 219/287 |
| 3,944,785 | 3/1976 | Eaton-Williams | 219/295 |
| 4,196,341 | 4/1980 | Williams | 219/295 |
| 4,221,955 | 9/1980 | Joslyn | 219/295 |

*Primary Examiner*—M. H. Paschall

[57] ABSTRACT

An electric boiler includes a conductivity control having a controller responsive to both steam pressure and electrode current. The controller is operative to open a boiler feed water discharge valve when either the steam pressure or electrode current falls below predetermined values to discharge water from the boiler for a predetermined time interval after which the controller closes the discharge valve and opens a feed water valve to initiate the delivery of feed water to the boiler chamber. When the pressure or current sensor senses the elevation of steam pressure or electrode current to second preselected levels the controller closes the feed water valve. In addition, if the sensors determine that the steam pressure or electrode current have risen to third preselective levels, a transfer valve is opened to transfer boiler water to a storage tank until the pressure or current level falls to fourth preselected levels.

11 Claims, 2 Drawing Figures

ELECTRIC BOILER

BACKGROUND OF THE INVENTION

This invention relates to electric boilers and more particularly to a conductivity control for such boilers.

Electric boilers generally include a plurality of electrodes which are at least partially submerged in a quantity of water contained within the boiler. The flow of electric current through the water and between the electrodes heats the water for the production of steam. As the water evaporates, the concentration of salts and other impurities in the water will tend to increase thereby affecting the water's conductivity. In order to achieve optimum operating conditions, it is therefore necessary to periodically replace at least a portion of the concentrated boiler water with fresh feed water. One prior art method of accomplishing this result was to withdraw and replace boiler water at preselected time intervals. This method was not always satisfactory because the boiler water replacement was made without regard to the concentration of impurities or boiler load.

Another prior art conductivity control system is disclosed in U.S. Pat. No. 3,760,775 wherein a current sensor determines when delivery of feed water is indicated and initiates a timer for discharging boiler water for a fixed time interval, after which a feed water valve is opened to permit the delivery of feed water. As the water level rises in the boiler, the resulting increase is current is detected by the current sensor terminating feed water delivery. This system was not wholly satisfactory, because the control was not able to adjust boiler water level in relation to the rapid changes in boiler pressure which accompany changes in steam loading changes.

SUMMARY OF THE INVENTION

There is an object of the invention to provide a new and improved conductivity control for electric boilers.

A further object of the invention is to provide a conductivity control for electric boilers which is responsive to load changes for adjusting boiler water level and controlling water conductivity.

These and other objects and advantages of the present invention are accomplished by an electric boiler conductivity control which includes a first sensor responsive to the fall of steam pressure below a first predetermined level to place the controller in a first mode wherein boiler water is discharged for a predetermined time and first means for placing said controller in a second mode at the end of said time for delivering feed water to the boiler. The pressure sensor is also operative when steam pressure arises above a third level to place the controller in a third mode for transferring boiler water to storage. An second sensor responsive to electrode current is also provided for placing said controller in said first or third modes should electrode current fall below or arise above preselected limits.

DETAILED DESCRIPTION OF THE PREFERRED EMBODIMENT

Figure 1:
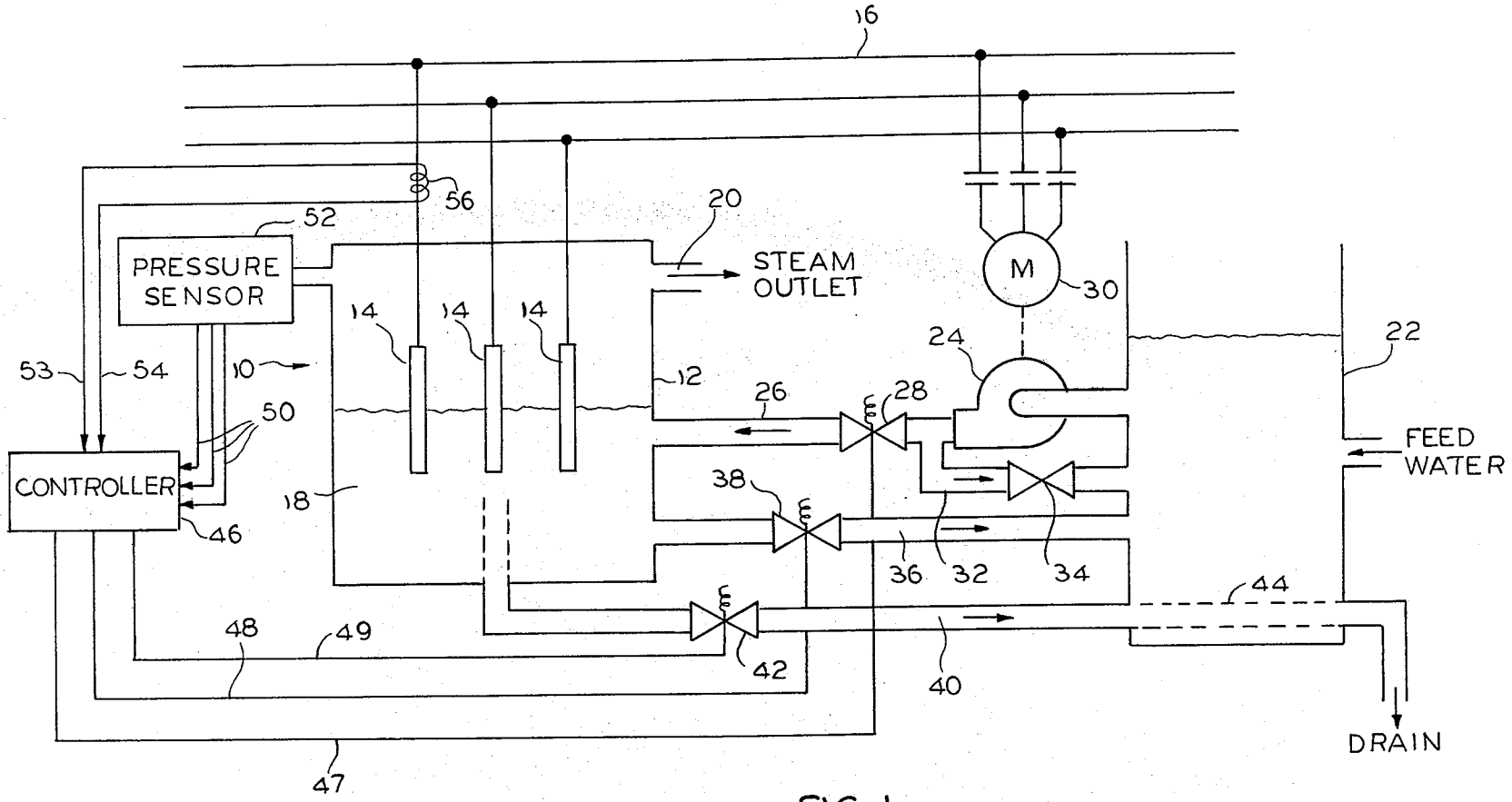
FIG. 1 schematically illustrates an electric boiler incorporating a conductivity control in accordance with the present invention.

FIG. 1 schematically illustrates an electric steam boiler 10 to include a vessel 12 in which a plurality of electrodes 14 are disposed. In the illustrated embodiment, three electrodes are each shown to be connected to one of the phases of a three phase alternating current power supply 16 and are at least partially submerged in a quantity of water 18 disposed within vessel 12. As those skilled in the art will appreciate, three phase currents flowing between electrodes 14 and through the water 18 results in the generation of steam which is withdrawn through an outlet 20 for the delivery to a load (not shown). The magnitude of the current flowing between the electrodes 14 and hence the steaming rate within vessel 12 is a function of the submerged depth and conductivity of the water 18.

Makeup feed water is supplied to boiler 10 from a holding tank 22 by means of a pump 24 which is connected to the tank 22 and to vessel 12 by conduit 26 and a solenoid operated feed valve 28. Pump 24 is continously driven by a motor 30 and accordingly a return conduit 32 and a pressure relief valve 34 provide a feed water return path to holding tank 22 when valve 28 is closed. The boiler vessel 12 and the holding tank 22 are also directly connected by a conduit 36 and a solenoid operated transfer valve 38 to permit a return of boiler water to holding tank 22. Also, concentrated boiler water may be discharged from vessel 12 by a drain conduit 40 and a solenoid operated conductivity control valve 42. A heat exchanger 44 may be provided in the holding tank for exchanging heat with the boiler water prior to discharge. The solenoid operated valves 28, 38 and 42 are each actuated by a controller 46 to which they are respectively connected by conductors 47, 48 and 49. Controller 46 is in turn connected by conductors 50 to a pressure sensor 52 coupled to the upper end of vessel 12 and by conductors 53 and 54 to a current transformer 56 coupled to one of the electrodes 14.

It will be appreciated that both the steam pressure and the phase current will be a function of water level and water conductivity. Conductivity is controlled by periodically discharging boiler water from vessel 12 to reduce the concentration of salts and water level is controlled by transferring boiler feed water between holding tank 22 and vessel 12. Toward this end, controller 46 is operable in response to signals from pressure sensor 52 which indicates a drop in steam pressure to a first set point value to open conductivity control valve 42 for discharging concentrated boiler water through conduit 40. After a predetermined time interval, controller 46 closes valve 42 and opens valve 28 for delivering unconcentrated feed water from holding tank 22 to vessel 12. By discharging boiler vessel 12 prior to the delivery of fresh feed water from holding tank 22, the amount of water that must be transferred in this manner is minimized. The delivery of feed water continues until pressure sensor 52 signals controller 46 that steam pressure has risen to a second set point at which time controller 46 closes feed water valve 28. If the steam load remains relatively constant, the pressure and water level within vessel 12 will fall and the cycle will be repeated when the first set point pressure is again reached. On the other hand, if the steam load should decrease causing a rise in the steam pressure to a third set point which is higher than the second set point, pressure sensor 52 will provide a third signal to controller 46 which then opens transfer valve 38 to return boiler water 18 to holding tank 22. This will continue until the boiler pressure falls to a fourth set point below the third.

The signal from current transformer 56 comprises a parallel input to controller 46. Specifically, there are four current set points similar to the pressure set points in that if the current set points are reached, the system will cycle through the same discharge and transfer functions. However, the system is normally adjusted so that the controls for their operations will be under the influence of the pressure sensor 52. The current controller will become operative only if the current flowing to the boiler moves out of the range of its rated value.

Figure 2:
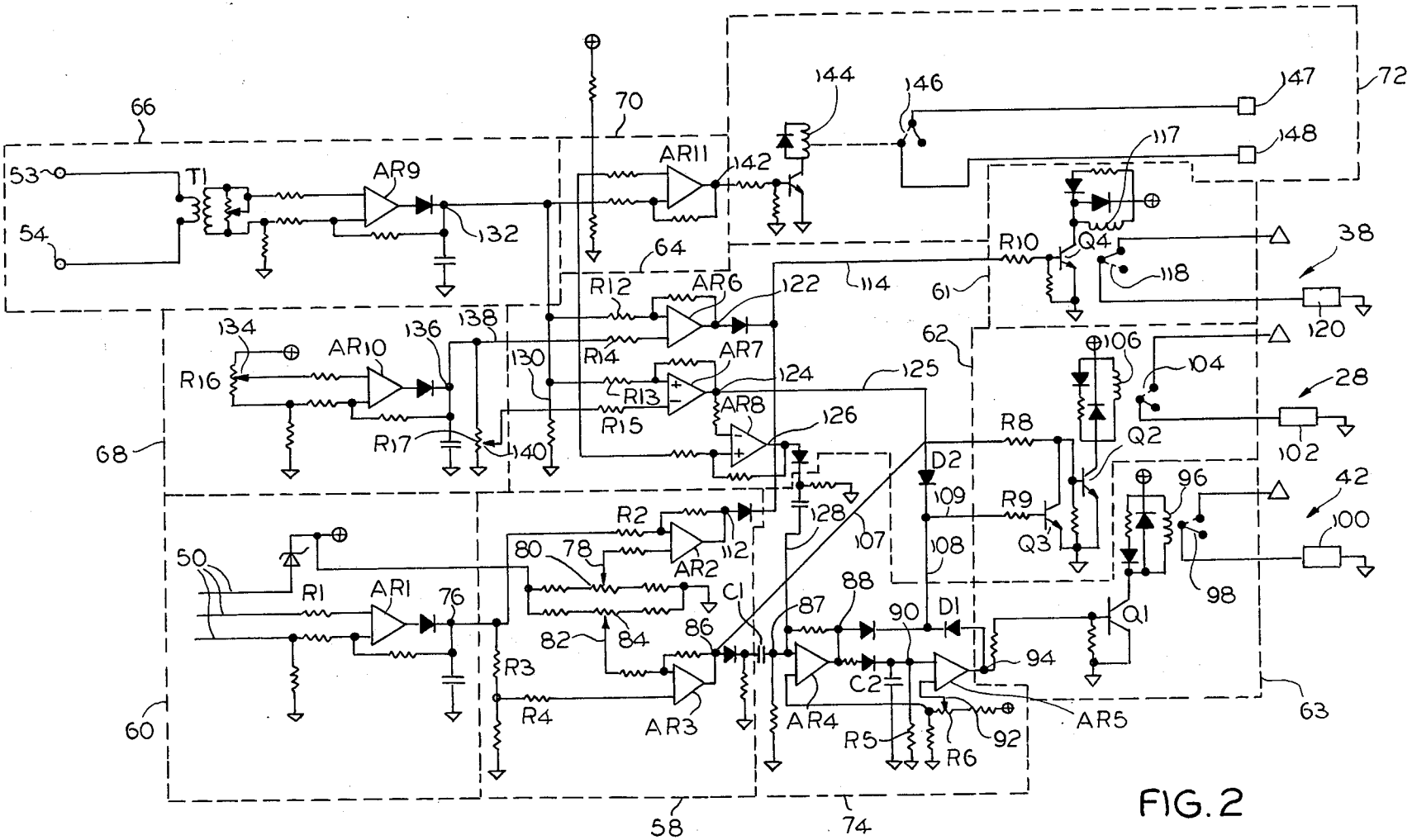
FIG. 2 schematically illustrates the electric circuitry of the conductivity control shown in FIG. 1.

FIG. 2 shows the controller 46 to include a pressure level sensing circuit 58 coupled through an input circuit 60 for receiving a signal functionally related to boiler pressure and operative to actuate an appropriate one of the energizing circuits 61, 62 or 63 of transfer valve 38, feed valve 28, and conductivity control valve 42, respectively. In addition, a current level sensing circuit 64 is connected to the current transformer conductors 53 and 54 through an input circuit 66. Current level sensing circuit 64 is also connected to a set point circuit 68 which establishes the various current set points for actuating the valve energizing circuits 61, 62 and 63. Also connected to the input circuit 66 is an overcurrent sensing circuit 70 which is operative to actuate an overcurrent relay 72 if the electrode current exceeds the rated capacity of the boiler. In addition, there is a timing circuit 74 dispersed between the pressure and current level sensing circuits 58 and 64 and the conductivity control valve energizing circuit 63 so that the conductivity control valve 42 will operate for a preselected time interval.

The pressure sensor input circuit 60 includes an operational amplifier AR1 whose noninverting terminal is connected to resistor R1 through pressure sensor output conductor 50 while its inverting terminal is connected to receive a feedback potential proportional to the output potential at terminal 76. Therefore, the potential at the output terminal 76 of AR1 will follow the pressure signal received at conductor 50. Terminal 76 is, in turn, connected through a resistor R2 to the noninverting terminal of an operational amplifier AR2 of the pressure level detecting circuit 58 and through resistors R3 and R4 to the inverting terminal of a second operational amplifier AR3 of circuit 58. The inverting terminal of AR2 is connected to the wiper 78 of a first set point potentiometer 80 and the noninverting terminal of AR3 is connected to the wiper 82 of a second set point potentiometer 84. The setting of wiper 78 will determine the upper or third pressure set point for the system and the setting of wiper 82 will determine the lower or first pressure set point.

The timing circuit 74 also includes a capacitor C1 connected between the output terminal 86 of AR3 and the noninverting terminal 87 of operational amplifier AR4. The output terminal 88 of AR4 is connected to capacitor C2 and resistor R5 and to the noninverting terminal of operational amplifier AR5. The inverting terminal of AR5 is connected to a wiper 92 on a potentiometer R6 to receive a potential which may be manually adjusted. The energizing circuit 63 of the conductivity control valve 42 includes a transistor Q1 whose base is coupled to the output terminal 94 of AR5 and whose emitter-collector circuit is connected in the energizing circuit of a relay coil 96.

When the pressure within the boiler is between the upper and lower set points, the output of operational amplifiers AR2 and AR3 will remain low. Assume, however, that boiler pressure falls below the lower set point. In this event, the potential at the inverting terminal of operational amplifier AR3, which follows boiler pressure, will fall below the potential on the noninverting terminal as set by wiper 82. The output terminal 86 of operational amplifier AR3, which is coupled to the timing circuit 74, will, therefore, go high to pulse the noninverting terminal of operational amplifier AR4. This momentarily forces the output 88 of operational amplifier AR4 to go high which charges capacitor C2. The output of AR4 then goes low so that capacitor C2 then discharges through resistor R5 to maintain the potential at the noninverting terminal of a third operational amplifier AR5 above its inverting terminal for a time which is determined by the setting of wiper 92 on resistor R6. During this period of time, the output terminal 94 of operational amplifier AR5 is high to turn on transistor Q1. While transistor Q1 is conductive, energizing current will be provided to the relay coil 96. This will move the relay contacts 98 from the position shown by full lines to that shown by broken lines whereupon the solenoid 100 of conductivity control valve 42 will be energized to discharge boiler water through drain pipe 40.

The discharge of boiler water will continue until capacitor C2 has discharged sufficiently such that the potential on the noninverting terminal of operational amplifier AR5 drops below that on the inverting terminal of AR5 which forces the output 94 of AR5 to turn transistor Q1 off. This deenergizes the relay coil 96 which opens contacts 98 and thereby open circuits solenoid 100 to close conductivity control valve 42. The duration of boiler feed water discharge is determined by the setting of wiper 92 on resistor R6 which the sets the potential on the inverting terminal of 5AR2 and hence the potential to which the noninverting terminal must fall before output terminal 94 goes low.

The feed valve 28 includes a solenoid 102 which is energized when the contacts 104 of a relay 106 are moved from their position shown by full lines to their position shown by broken lines in FIG. 2. Coil 106 is connected to the emitter-collector circuit of a transistor Q2. The base of transistor Q2 is connected to the output terminal 86 of operational amplifier AR3 by a conductor 107 and a resistor R8. Therefore, when the output terminal 86 of operational amplifier AR3 is high, transistor Q2 would normally receive a base signal and conduct energizing current to relay 106 so that the feed valve 26 would be open. It will be recalled too that terminal 86 will be high when the pressure within the boiler vessel 12 is below the first set point. Also when the pressure is below this level, the discharge valve 42 is opened as discussed above. In order to insure that the conductivity control valve 42 and feed valve 28 are not open simultaneously, a second transistor Q3 is connected across the transistor Q2 base circuit. The base of transistor Q3 is connected to the output terminal 94 of operational amplifier AR5 through conductors 108 and 109, resistor R9 and diode D1. During the time that the output terminal 94 of operational amplifier AR5 is high, therefore, a signal is provided to the base of the transistor Q3 which will be conductive and thereby retain transistor Q2 in an off condition. In this manner, simultaneous operation of the conductivity control valve 42 and the feed valve 28 are prevented. When terminal 94 goes low to effect the closure of discharge valve 42, transistor Q3 will turn off. As a result, transistor Q2 will turn on to energize the solenoid 102 so that feed valve 28 will open and feed water will be delivered to the boiler chamber 12 from holding tank 22.

As feed water is delivered to boiler chamber 12, the steam pressure will begin rising. Consequently, the potential at the inverting terminal of operational amplifier AR3 will begin rising relative to the potential at the noninverting terminal as determined by the set point which is fixed by the setting of wiper 82. The water level in boiler chamber 12 will continue to rise until the potential on the inverting terminal of AR3 passes a second set point, in which event output terminal 86 goes low to turn off transistor Q2 and thereby deenergize relay 106 to move contacts 104 to their open position and open circuit solenoid 102. This closes the feed valve 28. Because of the inherent characteristics of operational amplifier AR3, the potential on the inverting terminal which will initiate operation is lower than that required to terminate operation. Accordingly, the second pressure set point will be higher than the first set point so that the water in boiler chamber 12 will rise above the level which initiated the opening of conductivity control valve 42.

It will be recalled that the pressure level sensing circuit 58 is also operative to transfer boiler water from vessel 12 to holding tank 22 should the pressure within vessel 12 rise above a third set point. Toward this end, the output terminal 112 of operational amplifier AR2 is connected by conductor 114 and resistor R10 to the actuating circuit 61 of transfer value 38. The later circuit includes a transistor Q4 whose base is connected to resistor R10 and whose emitter-collector circuit is connected for completing an energizing circuit to relay coil 117 which is operative to move contacts 118 from their position shown by full lines to their position shown by broken lines wherein an energizing circuit is completed to solenoid 120 of transfer valve 38.

Should there be an increase in the pressure within boiler vessel 12, the potential on the noninverting terminal of operational amplifier AR2 will also rise. Should this potential exceed the set point potential at the inverting terminal of AR2 as determined by the position of wiper 78 on potentiometer 80, the output terminal 112 of operational amplifier AR2 will go high to turn transistor Q4 on and thereby open transfer valve 38. This will return boiler water to the holding tank 22 to lower the water level and steam pressure in vessel 12. The transfer of water from boiler vessel 12 to holding tank 22 will continue until steam pressure is lowered to a fourth set point. Again, because the potential at the noninverting terminal of operational amplifier AR2 which is necessary to initiate operation will be higher than that required for termination, the boiler pressure will continue to fall until it reaches the fourth set point which is lower than the third set point.

Under normal operating conditions, the feeding, transfer and discharge of boiler water will be under the control of the pressure sensor as discussed above. However, in order to insure that the current delivered to the boiler electrodes does not exceed rated values, the current level sensing circuit 64 and the over current sensing circuit 70 are provided. The current level sensing circuit 64 includes a first operational amplifier AR6 whose output terminal 122 is connected to the energizing circuit 61 of transfer valve 38 by conductor 114 and a second operational amplifier AR7 having an output terminal 124 connected to the energizing circuit 62 of feed valve 28 through conductors 125 and 109 and diode D2. In addition, there is a third operational amplifier AR8 whose output terminal 126 is connected by conductor 128 to terminal 87 of timing circuit 74. The noninverting terminals of operational amplifiers AR6 and AR7 are each respectively connected through resistors R12 and R13 to a conductor 130 which in turn is connected to current input circuit 66. The inverting terminals of each of the operational amplifiers AR6 and AR7 are connected respectively through resistors R14 and R15 to the set point circuit 68.

Input circuit 66 includes transformer T1 connected to current transformer conductors 53 and 54 so that a potential signal proportional to the current flowing in current transformer 56 will be provided at the output terminal 132 of operational amplifier AR9. This potential is in turn provided to noninverting inputs of operational amplifiers AR6 and AR7. The set point circuit 68 includes a first potentiometer R16 coupled to the positive supply and having a wiper 134 connected to operational amplifier AR10. A set point potential is thus provided at the output terminal 136 of AR10 which is determined by the position of wiper 134. This potential is provided to the inverting terminal of AR6 and to a second potentiometer R17 whose wiper 140 is connected to the inverting input of AR7.

Should the electrode current as reflected by the potential on conductor 130 fall below a first set point value as determined by the position of wiper 140 on resistor R17, the potential on the inverting terminal of AR7 will exceed that on the noninverting terminal and the output terminal 124 of AR7 will go low. This signal will be provided to the inverting terminal of operational amplifier AR8 which produces a pulse on conductor 128 which appears at terminal 87 of operational amplifier AR4. As indicated in the discussion with respect to the pressure sensor, this causes the conductivity control valve 42 to open for a predetermined time. Also, as discussed above, when output terminal 94 of operational amplifier AR5 is high, a base signal will be provided to transistor Q3 through conductors 125, 109 and resistor R9 so that transistor Q3 will be on and transistor Q2 will be held off so that the feed valve 28 can not be operated while the conductivity control valve 42 is open. At the end of the period during which water is discharged from vessel 12, the feed valve will be turned on by the pressure sensor in the manner discussed above.

Should the electrode current rise above a third set point value as determined by the position of wiper 134, the potential on the noninverting terminal of operational amplifier of AR6 will exceed that on the inverting terminal and an output signal will appear at terminal 122. This will turn on transistor Q4 to actuate the transfer valve 38 in the manner discussed below. The opening of transfer valve 38 will cause the water level in vessel 12 to begin decreasing whereupon the electrode current will begin to fall. This will continue until a fourth current set point is reached, whereupon the potential on the inverting terminal of operational amplifier AR6 will be insufficient to maintain an output signal at terminal 122 so that transfer valve 38 will close. Because the level of the potential at the noninverting terminal of AR6 required to initiate operation is higher than that necessary to sustain operation, the third current set point will be higher than the fourth. As a result, the level of water will fall below that which will trigger operation of the current control.

The over current sensing circuit 70 includes an operational amplifier AR11 whose noninverting terminal is connected to terminal 132 for receiving a potential signal functionally related to electrode current and whose inverting terminal is connected to the positive voltage source. Should electrode current exceed a preselected value, terminal 142 of operational amplifier AR11 will go high to energize relay coil 144. This moves contacts 146 from their position shown by full lines to the position shown by broken lines to provide an electric control signal at terminals 147, 148.

While only a single embodiment of the invention has been illustrated and described, it is not intended to be limited thereby but only by the scope of the appended claims.

I claim:

1. An electric boiler having a first vessel adapted to contain a quantity of water and electrodes disposed within said first vessel for heating said water to generate steam, pressure sensing and control means coupled to said first vessel for sensing the pressure therein for producing a first signal when said pressure falls below a first predetermined value, a second signal when said pressure rises above a second predetermined value after the occurrance of said first signal, a third signal when said pressure rises above a third value above said first and second values and a fourth signal when said pressure thereafter falls to a fourth value between said second and third values, said boiler also including a second vessel for containing a quantity of water, discharge means coupled to said first vessel and having a discharge mode for discharging water therefrom, timing means coupled to said discharge means and to said pressure sensing and control means and operative upon the receipt of said first signal to place the discharge means in its discharge mode and for maintaining the same in said mode for a predetermined time interval, transfer means interconnecting said first and second vessels and being operative to transfer water therebetween, said timing means being coupled to said transfer means and being operative to actuate said transfer means for the transfer of a second quantity of water from said second vessel to said first vessel after said predetermined time interval, said transfer means also being coupled to said pressure sensing and control means and being responsive to said second signal for terminating the transfer of water from said second vessel to said first vessel, said transfer means being responsive to said third signal for transferring water from said first vessel to said second vessel when the pressure in said first vessel exceeds said third predetermined value, said transfer means being operative to terminate the transfer of water from said first vessel upon the occurrence of said fourth signal.

2. The control set forth in claim 1 and including current sensing means coupled to said electrode means and operative to produce a second signal functionally related to the level of current therein, said second means also being coupled to said current sensing means and to said vessel and also being responsive to said second signal to discharge a first quantity of water from the vessel and for delivering a second quantity of water thereto when the electrode current falls to a first predetermined value, said second means being operative to transfer a third quantity of water from said vessel when said electrode current rises to a second predetermined level.

3. The system set forth in claim 1 wherein said second means includes inhibiting means coupled to said discharge means and to said feed means for preventing the operation of said feed means while said discharge means is in its discharge mode.

4. The system set forth in claim 3 and including level detecting means responsive to said signal for placing said discharge means in its discharge mode when the level of said signal falls to a first predetermined level and to initiate the operation of said transfer means when the level of said signal rises to a second predetermined value, said level detecting means being operative to terminate the operation of said feed means when the pressure in the vessel rises to a third predetermined value between said first and second values and to terminate the operation of said transfer means when the pressure in the vessel falls to a fourth predetermined level which is between said second and third levels.

5. The system set forth in claim 4 and including current sensing means coupled to said electrode means and operative to produce a second signal functionally related to electrode current, said level detecting means being responsive to said second signal for placing said discharge means in its discharge mode when the level of said second signal falls to a first predetermined level and to initiate the operation of said transfer means when the level of said second signal rises to a second predetermined value, said level detecting means also being operative to terminate the operation of said feed means when the said second signal rises to a third predetermined value between said first and second levels and to terminate the operation of said transfer means when said second signal falls to a fourth predetermined level which is between said second and third levels.

6. A conductivity control system for electric boilers having a vessel for containing a quantity of water, feed water storage means, electrode means disposed within said vessel, first means for sensing the pressure within the vessel and for producing a first signal when said pressure falls to a first predetermined level, a second signal when said pressure thereafter rises to a second predetermined level, a third signal when said pressure rises to a third level above said first and second levels and a fourth signal when said pressure falls to a fourth level between said second and third levels, transfer means coupled to said vessel and to said storage means and operative in a first mode for discharging water from said vessel and in a second mode for transferring water to said vessel from said storage means and a third mode for transferring water from said vessel to said storage means, control means coupled to said first means and responsive to said signals for placing said transfer means in its first mode for a predetermined time delay upon the receipt of said first signal when the level of said pressure falls to the first predetermined level and to place said transfer means in its second mode after said time delay, said control means being operative upon the receipt of said second signal when the level of said pressure rises to the second predetermined level to terminate the second mode of said transfer means, said control means also being operative to place said transfer means in its third mode upon the receipt of said third signal and to terminate said third mode upon the receipt of said fourth signal.

7. The system set forth in claim 6 wherein said transfer means includes a discharge valve having first operating means coupled to said first means and operative to open said valve means, upon the receipt of said first signal and timing means coupled to said operating means for maintaining the discharge valve in an open mode for a predetermined time, said transfer means also includes a feed valve means having second operating means for opening said feed valve to transfer water to said vessel from said storage means after the termination of said predetermined time, said transfer means also including a transfer valve having third operating means coupled to said first means and operative upon the receipt of said second signal to open said transfer valve for transferring water from vessel to said storage means, said third operating means being operative to close said transfer valve upon the receipt of said fourth signal.

8. A method of operating an electric boiler having a first chamber in which a quantity of water and electrodes are disposed and a second vessel containing water, and including the steps of:

measuring the pressure in said first chamber, discharging a quantity of water from said first chamber when the pressure therein falls to a first predetermined level, thereafter feeding water to said first vessel from said second vessel until the pressure within said first vessel rises to a second predetermined level, transferring water from said first vessel to said second vessel when the pressure in said first vessel rises to a third predetermined level which is above said second predetermined level, and terminating the transfer of water from said first chamber when the pressure therein falls to a fourth predetermined level which is between said second and third levels.

9. The method set forth in claim 8 wherein said discharging step is continued for a preselected time interval.

10. The method set forth in claims 8 or 9 and including the steps of:

at least partially covering the electrodes in said first chamber with water and energizing said electrodes with a current, discharging water from said first vessel when the electrode current falls to a first predetermined level, continuing the discharge of water from said first vessel for a preselected time interval, feeding water to said first vessel from said second vessel after the discharge of water from said first vessel and until the electrode current rises to a second predetermined level, transferring water from said first vessel to said second vessel when the electrode current rises to a third predetermined level which is above said second predetermined level, and terminating the transfer of water from said first vessel when the electrode current falls to a fourth predetermined level which is between said second and third levels.

11. The boiler set forth in claim 1 and including means for delivering feed water to said second vessel as the sole source of feed water to said boiler.

* * * * *